US009908734B2

(12) United States Patent
Jacobs et al.

(10) Patent No.: US 9,908,734 B2
(45) Date of Patent: Mar. 6, 2018

(54) PRINTING SYSTEM COMPRISING A SHEET SEPARATION SYSTEM

(71) Applicant: OCÉ-TECHNOLOGIES B.V., Venlo (NL)

(72) Inventors: Roy H. R. Jacobs, Venlo (NL); Reinoldus F. Winarto, Venlo (NL)

(73) Assignee: OCÉ-TECHNOLOGIES B.V., Venlo (NL)

( * ) Notice: Subject to any disclaimer, the term of this patent is extended or adjusted under 35 U.S.C. 154(b) by 45 days.

(21) Appl. No.: 14/824,785

(22) Filed: Aug. 12, 2015

(65) Prior Publication Data

US 2016/0059587 A1 Mar. 3, 2016

(30) Foreign Application Priority Data

Aug. 26, 2014 (EP) ..... 14182305

(51) Int. Cl.
*B65H 29/56* (2006.01)
*B41J 11/00* (2006.01)
(Continued)

(52) U.S. Cl.
CPC ..... *B65H 29/56* (2013.01); *B41J 11/007* (2013.01); *B41J 13/10* (2013.01); *B65H 11/005* (2013.01);
(Continued)

(58) Field of Classification Search
CPC .. B65H 11/005; B65H 29/242; B65H 29/245; B65H 29/54; B65H 29/56;
(Continued)

(56) References Cited

U.S. PATENT DOCUMENTS 4,218,125 A 8/1980 Silversberg
5,896,154 A 4/1999 Mitani et al.
(Continued)

FOREIGN PATENT DOCUMENTS

JP 2013-1553 A 1/2013
WO WO 2012/041726 A1 4/2012

*Primary Examiner* — Ernesto Suarez
(74) *Attorney, Agent, or Firm* — Birch, Stewart, Kolasch & Birch, LLP

(57) ABSTRACT

A printing system includes an endless metal transport belt for transporting sheets in a transport direction, wherein the metal transport belt comprises multiple through holes through which an underpressure or overpressure may be applied on the sheets, a sheet separation system for separating the sheets from the metal transport belt by applying a local overpressure, and a sheet separation guide which guides the separated sheets away from the metal transport belt. The sheet separation system includes a stationary sliding surface, wherein the metal transport belt slides over the stationary sliding surface, wherein the stationary sliding surface includes a number of blow holes which define the overpressure zone, and wherein the blow holes are configured to apply a local overpressure in the overpressure zone through the metal transport belt onto the underside of the sheets. The overpressure zone is formed in the curved part of the stationary sliding surface, wherein the overpressure zone has an upstream end and a downstream end, which are defined by the location of the blow holes, and wherein the sheet separation guide directly adjoins the overpressure zone at the downstream end thereof.

20 Claims, 8 Drawing Sheets

(51) Int. Cl.

| | |
|---|---|
| ***B65H 11/00*** | (2006.01) |
| ***B65H 29/24*** | (2006.01) |
| ***B41J 13/10*** | (2006.01) |
| *G03G 15/00* | (2006.01) |

(52) U.S. Cl.
CPC . *B65H 29/242* (2013.01); *B65H 2301/44735* (2013.01); *B65H 2401/15* (2013.01); *B65H 2404/25* (2013.01); *B65H 2404/27* (2013.01); *B65H 2406/364* (2013.01); *B65H 2801/15* (2013.01); *G03G 15/6529* (2013.01)

(58) Field of Classification Search
CPC .... B65H 2301/4461; B65H 2406/3124; B65H 2406/32; B65H 2406/322; B65H 2406/3221; B65H 2406/3223; B65H 2406/32231; B65H 2406/3622; B65H 2406/364; B65H 2406/365; B65H 2601/221; B65H 2601/273
USPC ..... 271/309
See application file for complete search history.

(56) References Cited

U.S. PATENT DOCUMENTS

| | | | | |
|---|---|---|---|---|
| 6,000,695 | A * | 12/1999 | Mack | B41F 21/08 271/183 |
| 6,224,203 | B1 * | 5/2001 | Wotton | B41J 11/005 347/101 |
| 6,494,452 | B1 * | 12/2002 | Karasiewicz | B65H 29/242 271/183 |
| 6,648,198 | B2 * | 11/2003 | Demers | D21G 9/0063 226/95 |
| 7,731,186 | B2 * | 6/2010 | Krause | B41F 21/08 271/193 |
| 8,702,098 | B2 * | 4/2014 | Clevers | B65H 5/224 271/196 |
| 2008/0001347 | A1 | 1/2008 | Krause et al. | |
| 2009/0084715 | A1 * | 4/2009 | Sakata | B65H 29/242 209/643 |
| 2010/0171804 | A1 | 7/2010 | Takahashi et al. | |
| 2016/0193856 | A1 * | 7/2016 | Haenen | B41J 11/007 347/104 |

* cited by examiner

PRINTING SYSTEM COMPRISING A SHEET SEPARATION SYSTEM

FIELD OF THE INVENTION

The present invention relates to an printing system comprising a sheet separation system and to a method of separating sheets from an endless metal transport belt in an Printing system.

BACKGROUND OF THE INVENTION

In printing systems, sheets are generally transported by a transport belt under the print station. For accuracy reasons, a metal transport belt may be preferred. At some point, the sheets need to be separated from the transport belt. This separation is generally performed at a curve where the transport belt changes direction.

In particular for paper sheets which have just received ink at the print station, the front end of the sheet may become curled as a result of the moisture of the ink. A radius of the curl may be quite small. The curl radius can be so small that the sheet separation becomes unreliable. For this reason, sheet separation systems have been developed which use a local blow zone where overpressure is applied on the underside of the sheets to separate the front end of the sheet from the transport belt and onto a paper guide. The blow units are generally positioned directly upstream of a guide roller where the transport belt changes direction. A paper guide for guiding the separated sheet away from the transport belt is generally positioned just downstream of the roller, more in particular just downstream of the highest point of the roller.

However, a metal transport belt needs to run over a curve having a relatively large radius, because otherwise excessive fatigue would occur in the metal transport belt, resulting in a shorter life span of the metal belt. Therefore a relatively large roller is required at the curved section.

It was recognized in the present invention that if a blow unit of a separation system would be positioned upstream of the roller for a metal transport belt, a relatively large radius of the roller would result in the blow unit being positioned relatively far from the paper guide, and this would disadvantageously affect the separation process.

WO2012/041726 of the present applicant discloses in FIG. 5 a separation system wherein a blow unit 26 is positioned upstream from a roller 14 and at a relatively large distance from the roller 14. A slight change in transport direction of the transport belt is induced in a slight bend to facilitate the separation. The blow unit is positioned just downstream of the small bend. The delivery station 101 is positioned downstream from the highest point of the roller 14, which is the usual position for the delivery station. It was recognized in the present invention that a gap exists between the blow zone 26 and the delivery station 101. The gap is quite large and it was recognized that this large gap disadvantageously affects the reliability of the separation process.

US2008/0001347 discloses a printing system having a sheet separation system. Reference is made to FIG. 3. A blowing unit 64 is located upstream of a guide roller 44 and applies a local overpressure to the underside of the sheets. A further blow unit 38 is located inside the guide roller to separate the sheets from the guide roller close to the paper guide. It was recognized in the present invention that a blow unit inside a guide roller is complex and that it is difficult to obtain a high quality of separation. This is due to the fact that it is very difficult to apply both underpressure and overpressure through the roller, wherein the underpressure is applied just upstream from the region where overpressure. The complexity of this system is also disadvantageous.

JP2013001553A describes an inkjet recorder in which a recording medium can be surely held on a conveying belt in a recording operation, and can be separated from the conveying belt at the terminating end of the conveying route.

US2010171804A discloses an image recording apparatus includes a conveyance unit which includes a conveyance belt and an air suction unit for sucking air through the conveyance belt to adsorb a recording medium onto the conveyance belt.

U.S. Pat. No. 5,896,154 A describes an ink jet printer wherein a belt-type preheating unit pressingly heats a recording sheet while transporting the recording sheet in a transport direction on a belt.

U.S. Pat. No. 4,218,125A discloses an apparatus in which a belt is supported to move in a pre-determined path.

OBJECT OF THE INVENTION

It is an object of the invention to provide a sheet separation system which separates sheets from a metal transport belt in a reliable manner, in particular sheets which have a somewhat curved front end as a result of wet ink.

It is a further object of the invention to provide a sheet separation system in which the distance between the region in which the separation of the sheets from the metal transport belt takes place and the sheet guide which guides the separated sheets away from the metal transport belt is relatively small.

SUMMARY OF THE INVENTION

In order to achieve at least one object, the invention provides a printing system comprising:

an endless metal transport belt for transporting sheets in a transport direction, wherein the metal transport belt comprises multiple through holes through which an underpressure or overpressure may be applied on the sheets, wherein the metal transport belt comprises a straight section and a curved section downstream from the straight section where the metal transport belt curves and changes direction, a sheet separation system for separating the sheets from the metal transport belt, wherein the sheets are separated from the metal transport belt by applying a local overpressure on an underside of the sheets in an overpressure zone, a sheet separation guide which guides the separated sheets away from the metal transport belt, wherein the sheet separation guide is positioned at the curved section, wherein the sheet separation system comprises a stationary sliding surface positioned under the metal transport belt and upstream of the sheet separation guide, wherein the metal transport belt slides over the stationary sliding surface, wherein the stationary sliding surface comprises a number of blow holes which define the overpressure zone, the blow holes being connected to a source of pressurized air, wherein the blow holes are configured to apply a local overpressure in the overpressure zone through the metal transport belt onto the underside of the sheets to separate a front end of the sheets from the metal transport belt, characterized in that the overpressure zone is formed in a curved part (124) of the stationary sliding surface, wherein the overpressure zone has an upstream end and a downstream end which are determined by the location of the blow holes, and wherein the sheet separation guide is adjacent to and/or directly adjoins the overpressure zone at the downstream end thereof.

The present provides an effective and reliable sheet separation system for a printing system having a metal transport belt. The difference with the prior art WO2012/041726 on which the preamble of claim 1 is based is the overpressure zone which is formed in a curved part of the stationary sliding surface and the location of the sheet separation guide directly downstream of the downstream end of the overpressure zone. As a result, a high reliability in sheet separation can be obtained. If a front end of the sheet is curled due to the ink, this will not result in problems in the sheet separation.

The disadvantage of the prior art WO2012/041726, lower reliability in case of a curled forward end of the sheet, is effectively avoided The curved sliding surface allows the overpressure zone to be positioned directly upstream of the sheet separation guide, or in other words, allows the sheet separation guide to be positioned directly downstream from the overpressure zone in a printing system having a metal transport belt. The large bending radius of the metal transport belt does not lead to a large distance between the overpressure zone and the sheet separation guide.

Upstream and downstream are viewed in the transport direction.

In an embodiment, the blow holes in the overpressure curved sliding surface are located in a region where the metal transport belt has an inclination angle ($\alpha$) to the horizontal of between 15 and 50 degrees. It was found that this is an effective angle.

In an embodiment, the stationary sliding surface comprises an upstream curved sliding surface which is located directly upstream from the overpressure zone, wherein the upstream curved sliding surface comprises holes which are connected to a suction device for applying underpressure on the sheets directly upstream of the overpressure zone. The suction zone which is positioned directly upstream from the results in a reliable transportation up to the overpressure zone.

The upstream curved sliding surface may go over in smooth manner into the overpressure curved sliding surface, i.e. without any edge which might hinder the sheets.
The stationary sliding surface may be an integral sliding surface to this end.

In an embodiment, the stationary sliding surface comprises an downstream curved sliding surface which is located downstream from the overpressure zone, wherein the downstream curved sliding surface guides the metal transport belt further along the curved section, and wherein the downstream curved sliding surface is in particular free of blow holes. In this way, the stationary sliding surface can guide the metal transport belt around the full curve.

In particular the stationary sliding surface may is defined by (or comprises) three distinct parts:

- an upstream curved sliding surface defining an underpressure zone,
- an overpressure curved sliding surface defining an overpressure zone,
- a downstream curved sliding surface which is positioned downstream from the sheet separation guide.

The stationary sliding surface may comprise an upstream straight sliding surface which is positioned upstream of the upstream curved sliding surface.

In an embodiment, the curved sliding part of the stationary sliding surface guides the metal transport belt along the entire curved section over an angle of at least 90 degrees.

In an embodiment, there is no roller at the curved section of the metal transport belt.

In an embodiment, a roller adjoins the overpressure curved sliding surface at the downstream end thereof and guides the metal transport belt downstream from the overpressure curved sliding surface, and wherein the transport belt is guided by the curve and the roller together.

In an embodiment, the stationary sliding surface is defined by a body having an underside which is curved and has a same curvature radius as a radius of the roller, wherein the curved underside is positioned in close proximity with the outer surface of the roller.

In an embodiment, the roller guides the metal transport belt over an angle of at most 70 degrees to a total angle of at least 90 degrees.

In an embodiment, the overpressure curved sliding surface is located at least partially vertically above the roller.

In an embodiment, the overpressure curved sliding surface is located vertically above a highest point of the roller.

In an embodiment, the overpressure curved sliding surface extends to a region downstream of the highest point of the roller. This ensures a smooth transition from the sliding surface to the roller and allows the overpressure curved sliding surface to extend to a region where the angle of said surface to the horizontal is at least 15 degrees.

In an embodiment, the overpressure curved sliding surface is located downstream of a vertical plane extending through an upstream point on the roller.

In an embodiment, the stationary sliding surface by itself or together with the roller guides the metal transport belt over a curvature of at least 90 degrees.

In an embodiment, the printing system is an inkjet printing system.

The present invention further relates to a method of separating sheets from an endless metal transport belt in a printing system, the method comprising:

providing a printing system comprising:

- an endless metal transport belt for transporting sheets in a transport direction, wherein the metal transport belt comprises multiple through holes through which an underpressure or overpressure may be applied on the sheets, wherein the metal transport belt comprises a straight section and a curved section downstream from the straight section where the metal transport belt curves and changes direction,
- a sheet separation system for separating the sheets from the metal transport belt, wherein the sheets are separated from the metal transport belt by applying a local overpressure on an underside of the sheets in an overpressure zone,
- a sheet separation guide which guides the separated sheets away from the metal transport belt, wherein the sheet separation guide is positioned at the curved section, wherein the sheet separation system comprises a stationary sliding surface positioned under the metal transport belt and upstream of the sheet separation guide, wherein the metal transport belt slides over the stationary sliding surface, wherein the stationary sliding surface comprises a number of blow holes which define the overpressure zone, the blow holes being connected to a source of pressurized air, wherein the blow holes are configured to apply a local overpressure in the overpressure zone through the metal transport belt onto the underside of the sheets to separate a front end of the sheets from the metal transport belt, wherein the overpressure zone is formed in a curved part of the stationary sliding surface, wherein the overpressure zone has an upstream end and a downstream end which are determined by the location of the blow holes, and wherein the sheet separation guide directly adjoins the overpressure zone at the downstream end thereof, the method further comprising:

transporting a sheet with the endless metal transport belt toward and along the curved section, wherein the metal transport belt is guided along at least a part of the curved section by the overpressure curved sliding surface of the stationary sliding surface, and wherein a local overpressure is applied through the blow holes, thereby separating a front end of the sheet from the metal transport belt, and guiding the sheet away from the metal transport belt by the sheet separation guide which directly adjoins the overpressure zone at the downstream end thereof.

The method has substantially the same advantages as the printing system according to the invention.

BRIEF DESCRIPTION OF THE DRAWINGS

The present invention will become more fully understood from the detailed description given herein below and accompanying schematic drawings which are given by way of illustration only and are not limitative of the invention, and wherein.

DETAILED DESCRIPTION

Overview of the Printing Process

Figure 1:
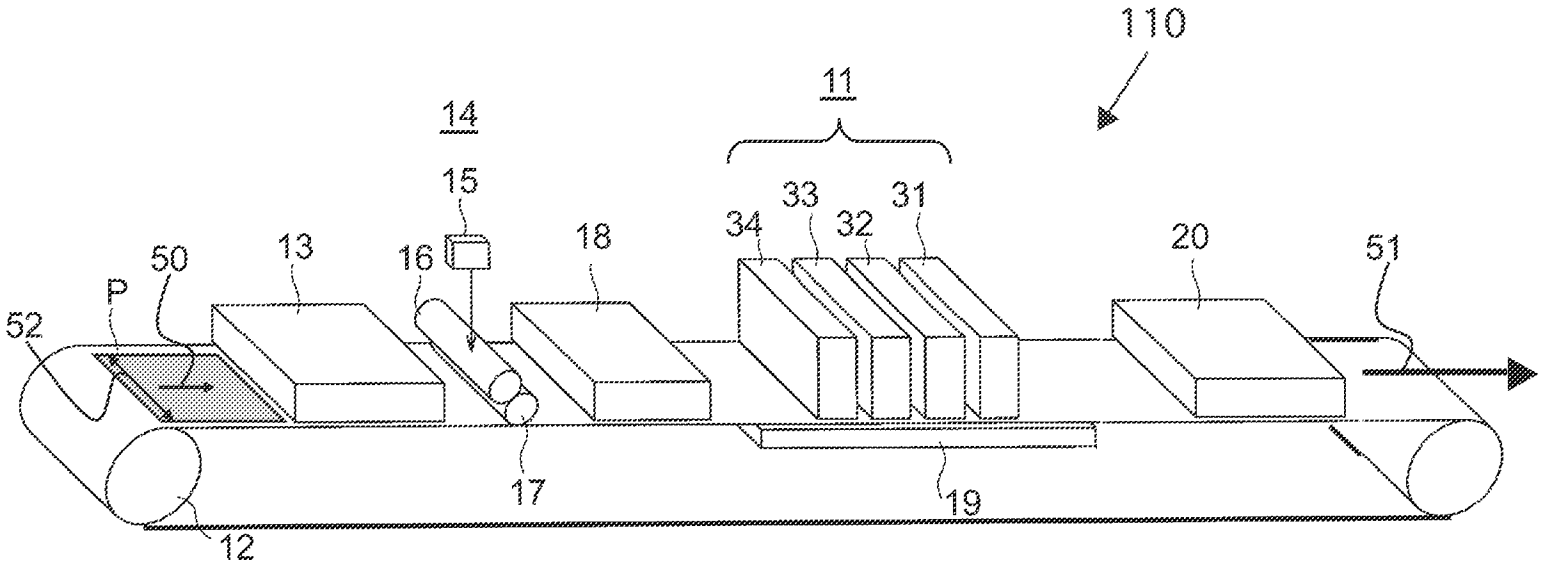
FIG. 1 shows a schematic representation of an inkjet printing system.

A printing process in which the inks according to the present invention may be suitably used is described with reference to the appended drawings shown in FIG. 1 and FIG. 2. FIGS. 1 and 2 show schematic representations of an inkjet printing system and an inkjet marking device, respectively.

FIG. 1 shows that a sheet of a receiving medium, in particular a machine coated medium, P, is transported in a direction for conveyance as indicated by arrows 50 and 51 and with the aid of transportation mechanism 12. Transportation mechanism 12 may be a driven belt system comprising one (as shown in FIG. 1) or more belts. Alternatively, one or more of these belts may be exchanged for one or more drums. A transportation mechanism may be suitably configured depending on the requirements (e.g. sheet registration accuracy) of the sheet transportation in each step of the printing process and may hence comprise one or more driven belts and/or one or more drums.

For a proper conveyance of the sheets of receiving medium, the sheets need to be fixed to the transportation mechanism. The way of fixation is not particularly limited and may be selected from electrostatic fixation, mechanical fixation (e.g. clamping) and vacuum fixation. Of these vacuum fixation is preferred.

The printing process as described below comprises of the following steps: media pre-treatment, image formation, drying and fixing and optionally post treatment.

Media Pre-Treatment

To improve the spreading and pinning (i.e. fixation of pigments and water-dispersed polymer particles) of the ink on the receiving medium, in particular on slow absorbing media, such as machine coated media, the receiving medium may be pretreated, i.e. treated prior to printing an image on the medium. The pre-treatment step may comprise one or more of the following:

preheating of the receiving medium to enhance spreading of the used ink on the receiving medium and/or to enhance absorption of the used ink into the receiving medium;

primer pre-treatment for increasing the surface tension of receiving medium in order to improve the wettability of the receiving medium by the used ink and to control the stability of the dispersed solid fraction of the ink composition (i.e. pigments and dispersed polymer particles). Primer pre-treatment may be performed in the gas phase, e.g. with gaseous acids such as hydrochloric acid, sulfuric acid, acetic acid, phosphoric acid and lactic acid, or in the liquid phase by coating the receiving medium with a pre-treatment liquid. The pre-treatment liquid may comprise water as a solvent, one or more cosolvents, additives such as surfactants and at least one compound selected from a polyvalent metal salt, an acid and a cationic resin;

corona or plasma treatment.

Primer Pre-Treatment

As an application way of the pre-treatment liquid, any conventionally known methods can be used. Specific examples of an application way include: a roller coating, an ink-jet application, a curtain coating and a spray coating. There is no specific restriction in the number of times with which the pre-treatment liquid is applied. It may be applied at one time, or it may be applied in two times or more. Application in two times or more may be preferable, since cockling of the coated printing paper can be prevented and the film formed by the surface pre-treatment liquid will produce a uniform dry surface having no wrinkle by applying in 2 steps or more.

Especially a roller coating (see 14 in FIG. 1) method is preferable because this coating method does not need to take into consideration of ejection properties and it can apply the pre-treatment liquid homogeneously to a recording medium. In addition, the amount of the applied pre-treatment liquid with a roller or with other means to a recording medium can be suitably adjusted by controlling: the physical properties of the pre-treatment liquid; and the contact pressure of a roller in a roller coater to the recording medium and the rotational speed of a roller in a roller coater which is used for a coater of the pre-treatment liquid. As an application area of the pre-treatment liquid, it may be possible to apply only to the printed portion, or to the entire surface of both the printed portion and the non-printed portion. However, when the pre-treatment liquid is applied only to the printed portion, unevenness may occur between the application area and a non-application area caused by swelling of cellulose contained in the coated printing paper with the water in the pre-treatment liquid followed by drying. Then, from the viewpoint of drying uniformly, it is preferable to apply a pre-treatment liquid to the entire surface of a coated printing paper, and roller coating can be preferably used as a coating method to the whole surface. The pre-treatment liquid may be an aqueous pre-treatment liquid.

Corona or Plasma Treatment

Corona or plasma treatment may be used as a pre-treatment step by exposing a sheet of a receiving medium to corona discharge or plasma treatment. In particular when used on media like polyethylene (PE) films, polypropylene (PP) films, polyetyleneterephtalate (PET) films and machine coated media, the adhesion and spreading of the ink can be improved by increasing the surface energy of the media. With machine coated media, the absorption of water can be promoted which may induce faster fixation of the image and less puddling on the receiving medium. Surface properties of the receiving medium may be tuned by using different gases or gas mixtures as medium in the corona or plasma treatment. Examples are air, oxygen, nitrogen, carbondioxide, methane, fluorine gas, argon, neon and mixtures thereof. Corona treatment in air is most preferred.

FIG. 1 shows that the sheet of receiving medium P may be conveyed to and passed through a first pre-treatment module 13, which module may comprise a preheater, for example a radiation heater, a corona/plasma treatment unit, a gaseous acid treatment unit or a combination of any of the above. Optionally and subsequently, a predetermined quantity of the pre-treatment liquid is applied on the surface of the receiving medium P at pre-treatment liquid applying member 14. Specifically, the pre-treatment liquid is provided from storage tank 15 of the pre-treatment liquid to the pre-treatment liquid applying member 14 composed of double rolls 16 and 17. Each surface of the double rolls may be covered with a porous resin material such as sponge.

After providing the pre-treatment liquid to auxiliary roll 16 first, the pre-treatment liquid is transferred to main roll 17, and a predetermined quantity is applied on the surface of the receiving medium P. Subsequently, the coated printing paper P on which the pre-treatment liquid was supplied may optionally be heated and dried by drying member 18 which is composed of a drying heater installed at the downstream position of the pre-treatment liquid applying member 14 in order to decrease the quantity of the water content in the pre-treatment liquid to a predetermined range. It is preferable to decrease the water content in an amount of 1.0 weight % to 30 weight % based on the total water content in the provided pre-treatment liquid provided on the receiving medium P.

In order to prevent the transportation mechanism 12 being contaminated with pre-treatment liquid, a cleaning unit may be installed and/or the transportation mechanism may be comprised multiple belts or drums as described above. The latter measure prevents contamination of the upstream parts of the transportation mechanism, in particular of the transportation mechanism in the printing region.

Image Formation

Image formation is performed in such a manner that, employing a printing system loaded with inkjet inks, ink droplets are ejected from the inkjet heads based on the digital signals onto a print medium.

Although both single pass inkjet printing and multi pass (i.e. scanning) inkjet printing may be used for image formation, single pass inkjet printing is preferably used since it is effective to perform high-speed printing. Single pass inkjet printing is an inkjet recording method with which ink droplets are deposited onto the receiving medium to form all pixels of the image by a single passage of a receiving medium underneath an inkjet marking module.

In FIG. 1, 11 represents an inkjet marking module of a printing system 110 comprising four inkjet marking devices, indicated with 31, 32, 33 and 34, each arranged to eject an ink of a different color (e.g. Cyan, Magenta, Yellow and Black). The nozzle pitch of each head is e.g. about 360 dpi. In the present invention, "dpi" indicates a dot number per 2.54 cm.

An inkjet marking device for use in single pass inkjet printing, 31, 32, 33, 34, has a length, L, of at least the width of the desired printing range, indicated with double arrow 52, the printing range being perpendicular to the media transport direction, indicated with arrows 50 and 51. The inkjet marking device may comprise a single printhead having a length of at least the width of said desired printing range. The inkjet marking device may also be constructed by combining two or more inkjet heads, such that the combined lengths of the individual inkjet heads cover the entire width of the printing range.

Figure 2A:
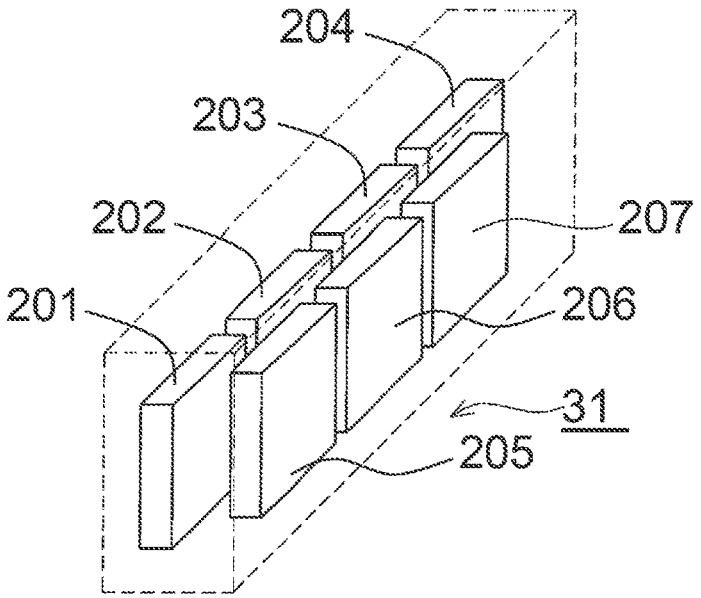
FIG. 2A shows a schematic representation of an inkjet marking device.
Figure 2B:
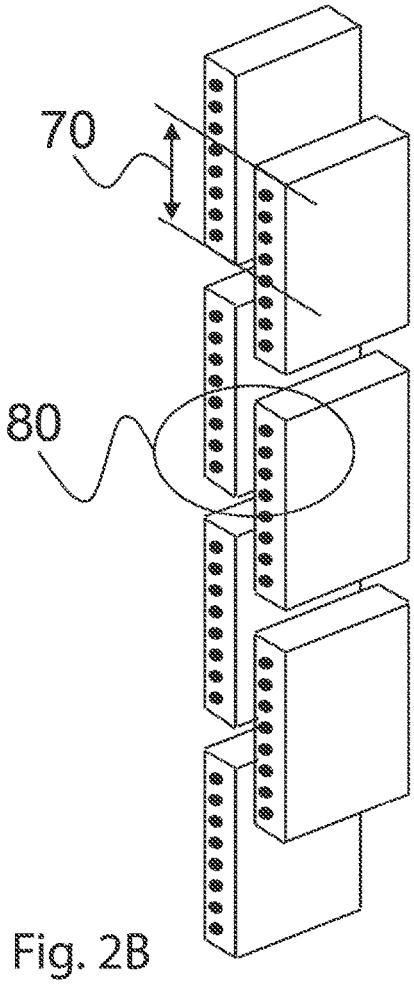
FIG. 2B: shows a schematic representation of an assembly of inkjet heads.
Figure 2C:
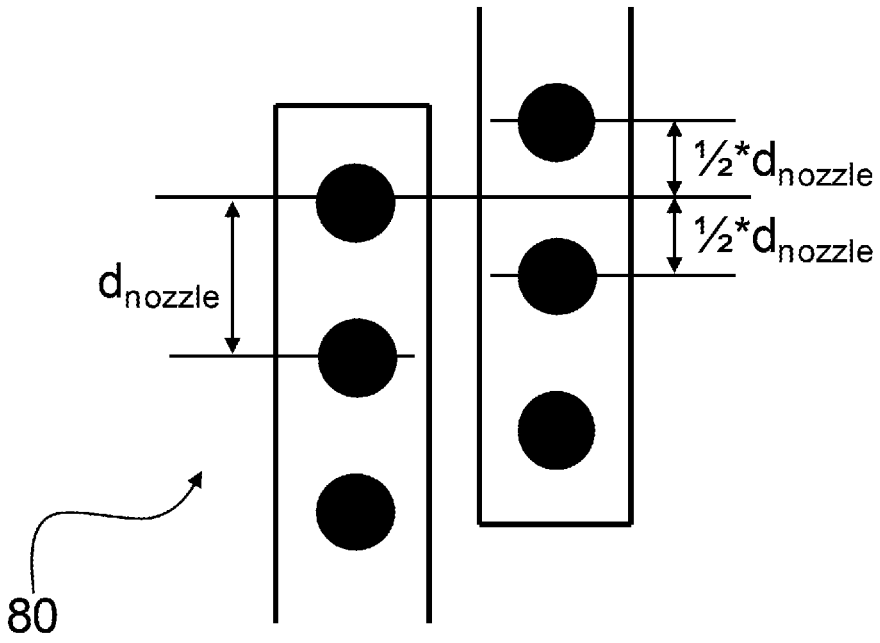
FIG. 2C: shows a detailed view of a part of the assembly of inkjet heads.

Such a constructed inkjet marking device is also termed a page wide array (PWA) of printheads. FIG. 2A shows an inkjet marking device 31 (32, 33, 34 may be identical) comprising 7 individual inkjet heads (201, 202, 203, 204, 205, 206, 207) which are arranged in two parallel rows, a first row comprising four inkjet heads (201-204) and a second row comprising three inkjet heads (205-207) which are arranged in a staggered configuration with respect to the inkjet heads of the first row.

The staggered arrangement provides a page wide array of nozzles which are substantially equidistant in the length direction of the inkjet marking device. The staggered configuration may also provide a redundancy of nozzles in the area where the inkjet heads of the first row and the second row overlap, see 70 in FIG. 2B. Staggering may further be used to decrease the nozzle pitch (hence increasing the print resolution) in the length direction of the inkjet marking device, e.g. by arranging the second row of inkjet heads such that the positions of the nozzles of the inkjet heads of the second row are shifted in the length direction of the inkjet marking device by half the nozzle pitch, the nozzle pitch being the distance between adjacent nozzles in an inkjet head, $d_{nozzle}$ (see FIG. 2C, which represents a detailed view of 80 in FIG. 2B). The resolution may be further increased by using more rows of inkjet heads, each of which are arranged such that the positions of the nozzles of each row are shifted in the length direction with respect to the positions of the nozzles of all other rows.

In image formation by ejecting an ink, an inkjet head (i.e. printhead) employed may be either an on-demand type or a continuous type inkjet head. As an ink ejection system, there may be usable either the electric-mechanical conversion system (e.g., a single-cavity type, a double-cavity type, a bender type, a piston type, a shear mode type, or a shared wall type), or an electric-thermal conversion system (e.g., a thermal inkjet type, or a Bubble Jet type (registered trade name)). Among them, it is preferable to use a piezo type inkjet recording head which has nozzles of a diameter of 30 μm or less in the current image forming method.

FIG. 1 shows that after pre-treatment, the receiving medium P is conveyed to upstream part of the inkjet marking module 11. Then, image formation is carried out by each color ink ejecting from each inkjet marking device 31, 32, 33 and 34 arranged so that the whole width of the receiving medium P is covered.

Optionally, the image formation may be carried out while the receiving medium is temperature controlled. For this purpose a temperature control device 19 may be arranged to control the temperature of the surface of the transportation mechanism (e.g. belt or drum) underneath the inkjet marking module 11. The temperature control device 19 may be used to control the surface temperature of the receiving medium P, for example in the range of 30° C. to 60° C.

The temperature control device 19 may comprise heaters, such as radiation heaters, and a cooling means, for example a cold blast, in order to control the surface temperature of the receiving medium within said range. Subsequently and while printing, the receiving medium P is conveyed to the downstream part of the inkjet marking module 11.

Drying and Fixing

After an image has been formed on the receiving medium, the prints have to be dried and the image has to be fixed onto the receiving medium. Drying comprises the evaporation of solvents, in particular those solvents that have poor absorption characteristics with respect to the selected receiving medium.

FIG. 1 schematically shows a drying and fixing unit 20, which may comprise a heater, for example a radiation heater. After an image has been formed, the print is conveyed to and passed through the drying and fixing unit 20. The print is heated such that solvents present in the printed image, to a large extent water, evaporate. The speed of evaporation and hence drying may be enhanced by increasing the air refresh rate in the drying and fixing unit 20.

Simultaneously, film formation of the ink occurs, because the prints are heated to a temperature above the minimum film formation temperature (MFT). The residence time of the print in the drying and fixing unit 20 and the temperature at which the drying and fixing unit 20 operates are optimized, such that when the print leaves the drying and fixing unit 20 a dry and robust print has been obtained. As described above, the transportation mechanism 12 in the fixing and drying unit 20 may be separated from the transportation mechanism of the pre-treatment and printing section of the printing apparatus and may comprise a belt or a drum.

Post Treatment

To increase the print robustness or other properties of a print, such as gloss level, the print may be post treated, which is an optional step in the printing process.

In an embodiment, the prints may be post treated by laminating the prints.

In an embodiment, the post-treatment step comprises a step of applying (e.g. by jetting) a post-treatment liquid onto the surface of the coating layer, onto which the inkjet ink has been applied, so as to form a transparent protective layer on the printed recording medium. In the post-treatment step, the post-treatment liquid may be applied over the entire surface of an image on the recording medium or may be applied only to specific portions of the surface of an image. The method of applying the post-treatment liquid is not particularly limited, and is selected from various methods depending on the type of the post-treatment liquid.

However, the same method as used in the coating method of the pre-treatment liquid or an inkjet printing method is preferably used. Of these methods, inkjet printing method is particularly preferable in view of, avoiding contact between the printed image and the used post-treatment liquid applicator; the construction of an inkjet recording apparatus used; and the storage stability of the post-treatment liquid. In the post-treatment step, a post-treatment liquid containing a transparent resin is applied on the surface of a formed image so that a dry adhesion amount of the post-treatment liquid is 0.5 g/m$^2$ to 10 g/m$^2$, preferably 2 g/m$^2$ to 8 g/m$^2$, thereby forming a protective layer on the recording medium.

When the dry adhesion amount is less than 0.5 g/m$^2$, almost no improvement in image quality (image density, color saturation, glossiness and fixability) is obtained. When the dry adhesion amount is more than 10 g/m$^2$, it is disadvantageous in cost efficiency, because the dryness of the protective layer degrades and the effect of improving the image quality is saturated.

As a post-treatment liquid, an aqueous solution comprising components capable of forming a transparent protective layer over a recording medium (e.g. a water-dispersible resin, a surfactant, water, and additives as required) is preferably used. The water-dispersible resin comprised in the post-treatment liquid, preferably has a glass transition temperature ($T_g$) of −30° C. or higher, and more preferably in the range of −20° C. to 100° C. The minimum film forming temperature (MFT) of the water-dispersible resin is preferably 50° C. or lower, and more preferably 35° C. or lower. The water-dispersible resin may be radiation curable to improve the glossiness and fixability of the image.

As the water-dispersible resin, for example, an acrylic resin, a styrene-acrylic resin, a urethane resin, an acrylsilicone resin, a fluorine resin and the like are preferably used. The water-dispersible resin can be suitably selected from the same materials as that used for the inkjet ink. The amount of the water-dispersible resin contained, as a solid content, in the protective layer is preferably 1% by mass to 50% by mass.

The surfactant comprised in the post-treatment liquid is not particularly limited and may be suitably selected from those used in the inkjet ink. Examples of the other components of the post-treatment liquid include antifungal agents, antifoaming agents, and pH adjustors.

Hitherto, the printing process was described such that the image formation step was performed in-line with the pre-treatment step (e.g. application of an (aqueous) pre-treatment liquid) and a drying and fixing step, all performed by the same apparatus (see FIG. 1). However, the printing process is not restricted to the above-mentioned embodiment. A method in which two or more machines are connected through a belt conveyor, drum conveyor or a roller, and the step of applying a pre-treatment liquid, the (optional) step of drying a coating solution, the step of ejecting an inkjet ink to form an image and the step or drying an fixing the printed image are performed. It is, however, preferable to carry out image formation with the above defined in-line image forming method.

Sheet Separation According to the Prior Art

Figure 3A:
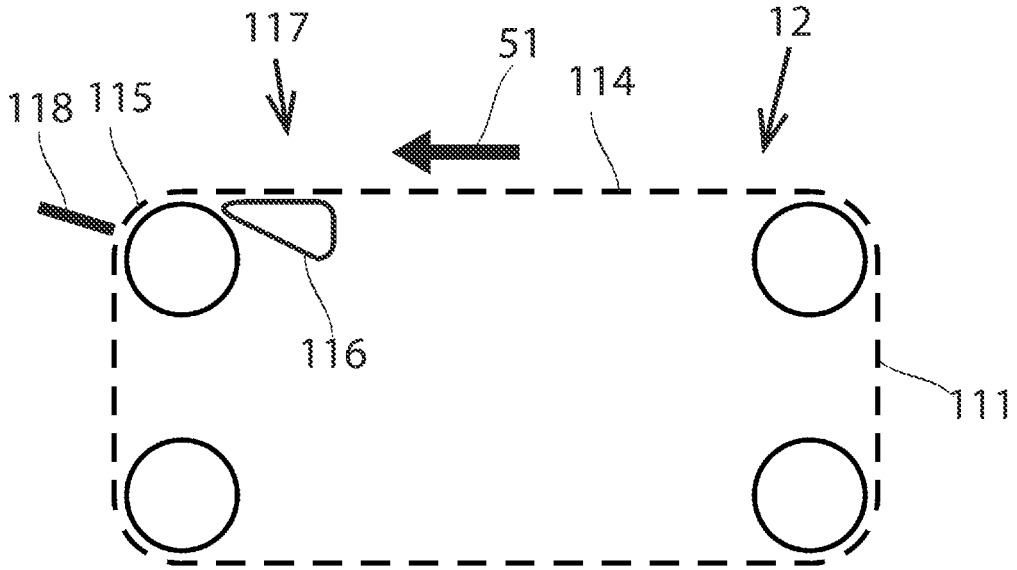
FIG. 3A shows a schematic side view of a transport belt and a sheet separation system of the prior art.
Figure 3B:
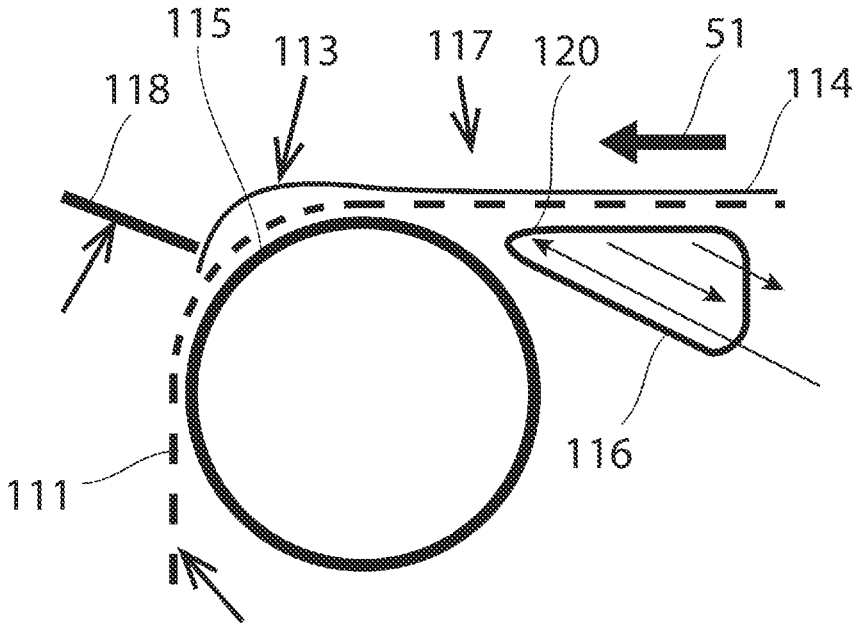
FIG. 3B shows a side view of a sheet separation system of the prior art.

Turning to FIGS. 3A and 3B, in a printing system 110 of the prior art a sheet transportation mechanism 12 comprises an endless metal transport belt 111 for transporting sheets 113 in the transport direction 51. The metal transport belt comprises multiple through holes through which an underpressure or overpressure may be applied on the sheets. The metal transport belt comprises a straight section 114 and a curved section 115 which is downstream from the straight section where the metal transport belt curves and changes direction.

The printing system comprises a sheet separation system 116 for separating the sheets from the metal transport belt. The sheets are separated from the metal transport belt by applying a local overpressure on the underside of the sheets in an overpressure zone 117.

A sheet separation guide 118 is provided which guides the separated sheets away from the metal transport belt. The sheet separation guide is positioned at the curved section 115. The sheet separation guide 118 may be a plate but may also comprise a further transport system for further transporting the sheets.

The sheet separation system comprises a stationary sliding surface 120 positioned under the metal transport belt and upstream of the sheet separation guide 118. The metal transport belt slides over the stationary sliding surface 120.

Sheet Separation System According to the Invention

Figure 4A:
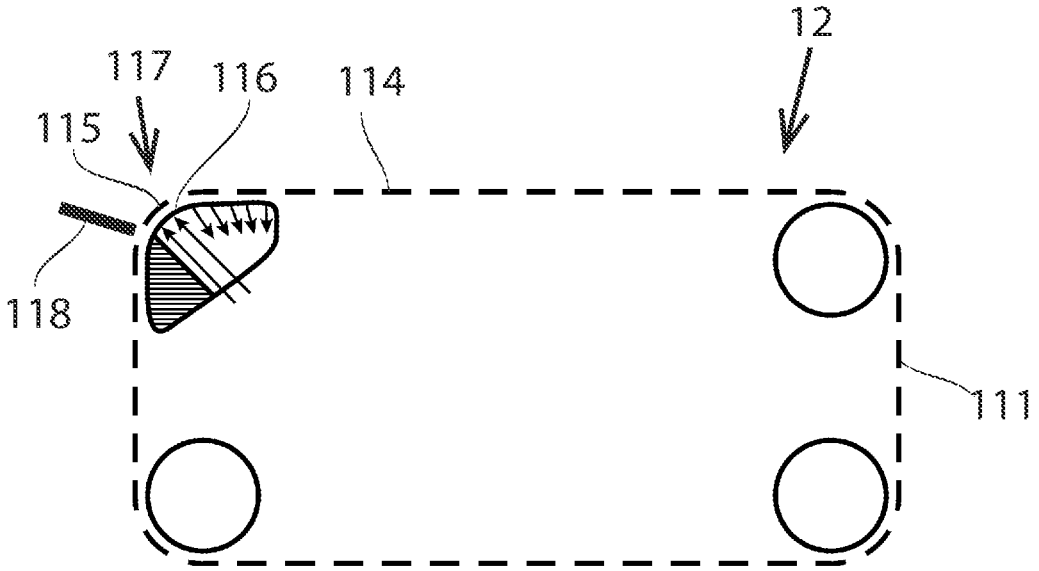
FIG. 4A shows a schematic side view of a transport belt and a sheet separation system of a first embodiment of the invention.
Figure 4B:
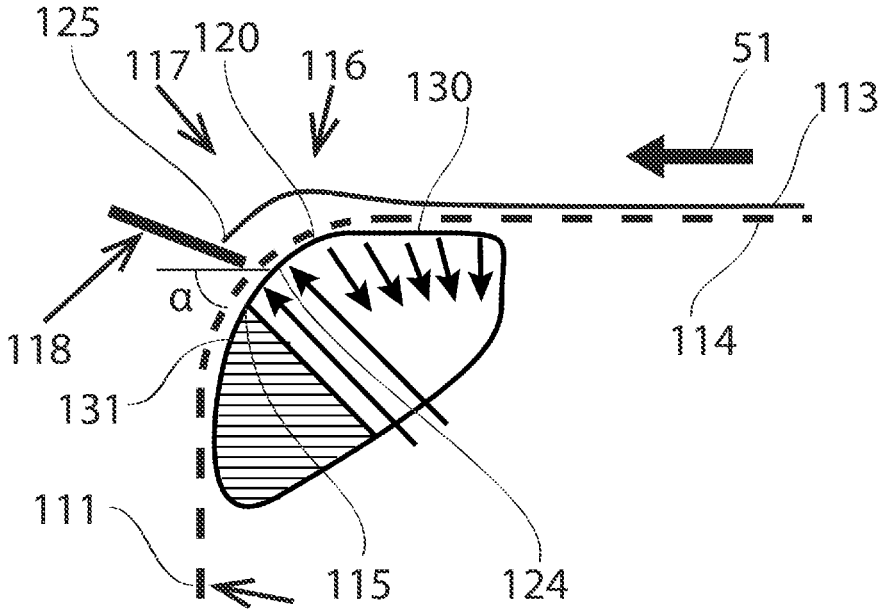
FIG. 4B shows a side view of a sheet separation system of the first embodiment.
Figure 4C:
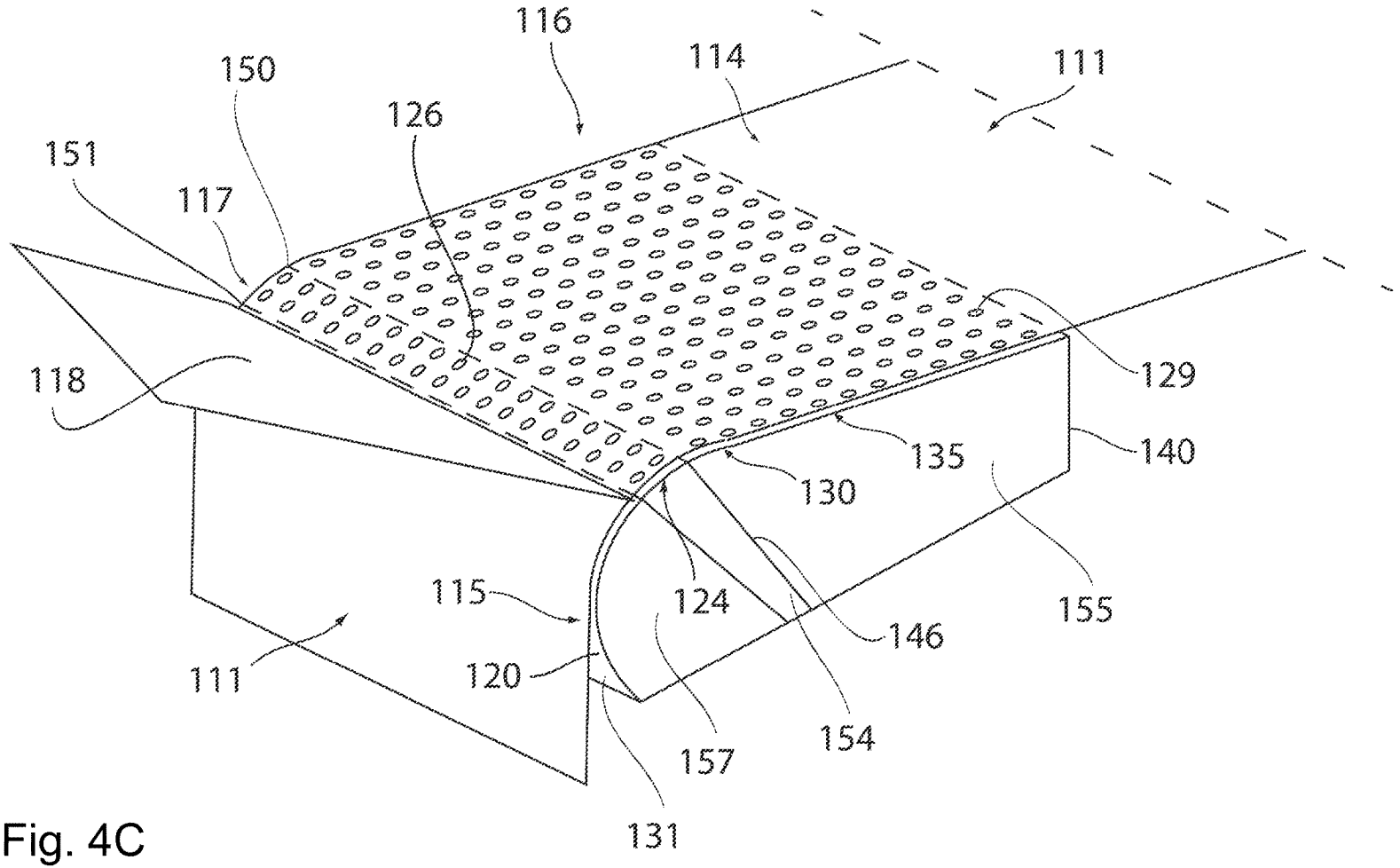
FIG. 4C shows an isometric view of a sheet separation system of the first embodiment.

Turning to FIGS. 4A, 4B and 4C, a first embodiment of the invention is shown. In the embodiment of FIGS. 4A, 4B and 4C, there is no roller at the curved section 115 of the metal transport belt.

The sheet separation system 116 comprises a stationary sliding surface 120 which is positioned under the metal transport belt. The sliding surface is positioned upstream of the sheet separation guide 118. The metal transport belt slides over the stationary sliding surface. The entire curved section 115 of the metal transport belt is guided by the stationary sliding surface 120. The stationary sliding surface 120 is formed by a body 140 having a curved upper wall.

The stationary sliding surface comprises a number of blow holes (126) which define the overpressure zone. The blow holes may take the form of elongate slots, in particular slots which extend transverse to the transport direction, oblique to the transport direction and/or parallel to the transport direction. The blow holes may also be circular holes.

The blow holes being connected to a source of pressurized air. The blow holes are configured to apply a local overpressure in the overpressure zone through the metal transport belt onto the underside of the sheets to separate a front end 125 of the sheets from the metal transport belt.

The overpressure zone is formed in a curved part 124 of the stationary sliding surface. The overpressure zone has an upstream end and a downstream end. The sheet separation guide directly adjoins the overpressure zone at the downstream end thereof.

The stationary sliding surface 120 comprises a number of blow holes 28 which extend through the upper wall of the body 140. The stationary sliding surface 120 is smooth and is manufactured from a smooth material having a low friction coefficient. The overpressure zone 117 is defined by the blow holes and has an upstream end 150 and a downstream end 151. The upstream end 150 is defined by an upstream row of blow holes. The downstream end 150 is defined by a downstream row of blow holes. The overpressure zone does not extend beyond the area covered by the blow holes.

The curved part 124 which forms the overpressure zone is also indicated as overpressure curved sliding surface 124. The overpressure curved sliding surface 124 guides the metal transport belt along at least a part of the curved section 115 of the metal transport belt 111.

The blow holes are connected to a source of pressurized air. The blow holes are configured to apply a local overpressure through the metal transport belt onto the underside of the sheets to separate a front end 125 of the sheets from the metal transport belt 111.

The overpressure zone has upstream end and a downstream end. The stationary sliding surface is curved between said upstream and downstream end of the overpressure zone.

The sheet separation guide 118 directly adjoins the overpressure zone. Only the metal transport belt runs through a small gap between the sheet separation guide and the overpressure zone.

The combination of an overpressure zone having a overpressure curved sliding surface 124 and the close proximity of the sheet separation guide to the overpressure zone results in a reliable separation.

The overpressure curved sliding surface 124 of the overpressure zone is different from the prior art because in the prior art, the overpressure zone is located on a flat guiding surface. Moreover, the overpressure zone of the prior art is located at a substantial distance from the sheet separation guide 118. This can be seen in FIG. 5 of WO2012/041726. The blow unit 26 has a flat upper surface. In addition, the blow unit is positioned at a substantial distance from the sheet separation guide 101, which results in a less reliable system.

The overpressure zone is located in a region where the metal transport belt has an inclination angle ($\alpha$) to the horizontal of between 15 and 50 degrees.

The stationary sliding surface 120 comprises an upstream curved sliding surface 130 which is located upstream from the overpressure zone. The upstream curved sliding surface comprises holes which are connected to a suction device for applying underpressure on the sheets directly upstream of the overpressure zone.

Upstream of the upstream curved sliding surface, the stationary sliding surface 120 may comprise a straight sliding surface 135, which straight sliding surface extends into the straight section 114.

The stationary sliding surface 120 further comprises a downstream curved sliding surface 131 which is located downstream from the overpressure zone. The downstream curved sliding surface guides the metal transport belt further along the curved section. The downstream curved sliding surface is in particular free of blow holes.

The upstream curved sliding surface 130, the overpressure curved sliding surface 124 of the overpressure zone and the downstream curved sliding surface 131 may together define a curvature of at least 90 degrees. The stationary sliding surface guides the metal transport belt along the entire curved section 115.

Turning in particular to FIG. 4C, the blow holes 126 are shown. The blow holes are located underneath the metal transport belt 111 and for this reason the blow holes 126 are shown in dashed lines. The overpressure zone 117 is defined by the area where the blow holes are located. The overpressure zone has an upstream end 150 and a downstream end 152 which are both indicated by dashed lines. The upstream curved sliding surface 130 is shown with its suction holes 129. For clarity purposes, only a part of the suction holes 129 are shown.

The body 140 which defines the stationary sliding surface 120 comprises a partition wall 146 which divides the interior volume in an overpressure chamber 154 and an underpressure chamber 155. The over pressure chamber is connected to a source of pressurized air and the underpressure chamber is connected to a suction device. A further partition wall 147 is provided which separates the overpressure chamber 154 from a chamber 157 which is neither in overpressure nor in underpressure. This part of the body 140 may also be solid.

The sheet separation guide 118 has an upstream edge 156 which directly adjoins the overpressure zone 117.

In operation, sheets are transported by the endless metal transport belt 111 in a transport direction 51. The metal transport belt comprises multiple holes through which an underpressure is applied on the sheets. As a result of the underpressure the sheets remain attached to the metal transport belt. The metal transport belt comprises a straight section 114 and a curved section 115. The curved section is located downstream from the straight section. In the curved section, the metal transport belt curves and changes direction.

When the sheets reach the curved section a local overpressure is applied on the front end of the sheets through the blow holes 28 in the curve and through the through holes in the metal transport belt. A front end 125 of the sheet is separated from the metal transport belt as a result of the local overpressure.

Figure 5A:
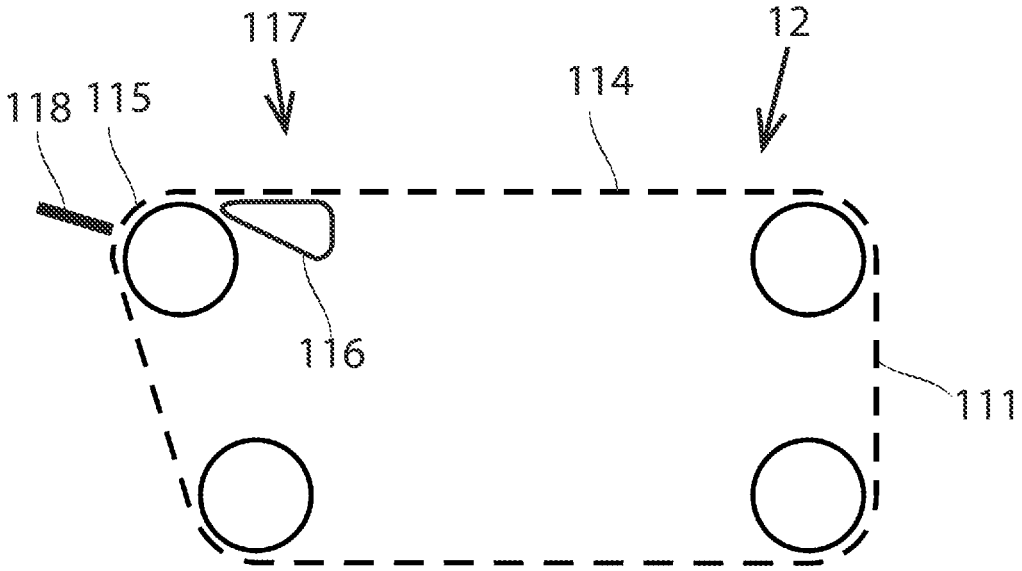
FIG. 5A shows a schematic side view of a transport belt and a sheet separation system of a second embodiment of the invention.
Figure 5B:
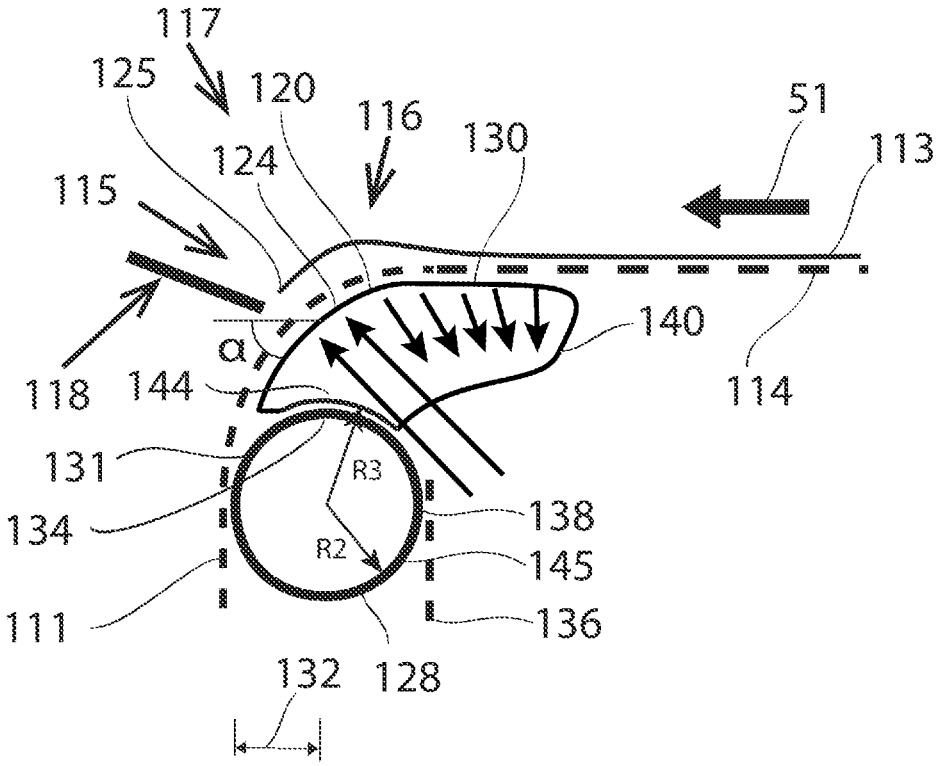
FIG. 5B shows a side view of a sheet separation system of the second embodiment.
Figure 5C:
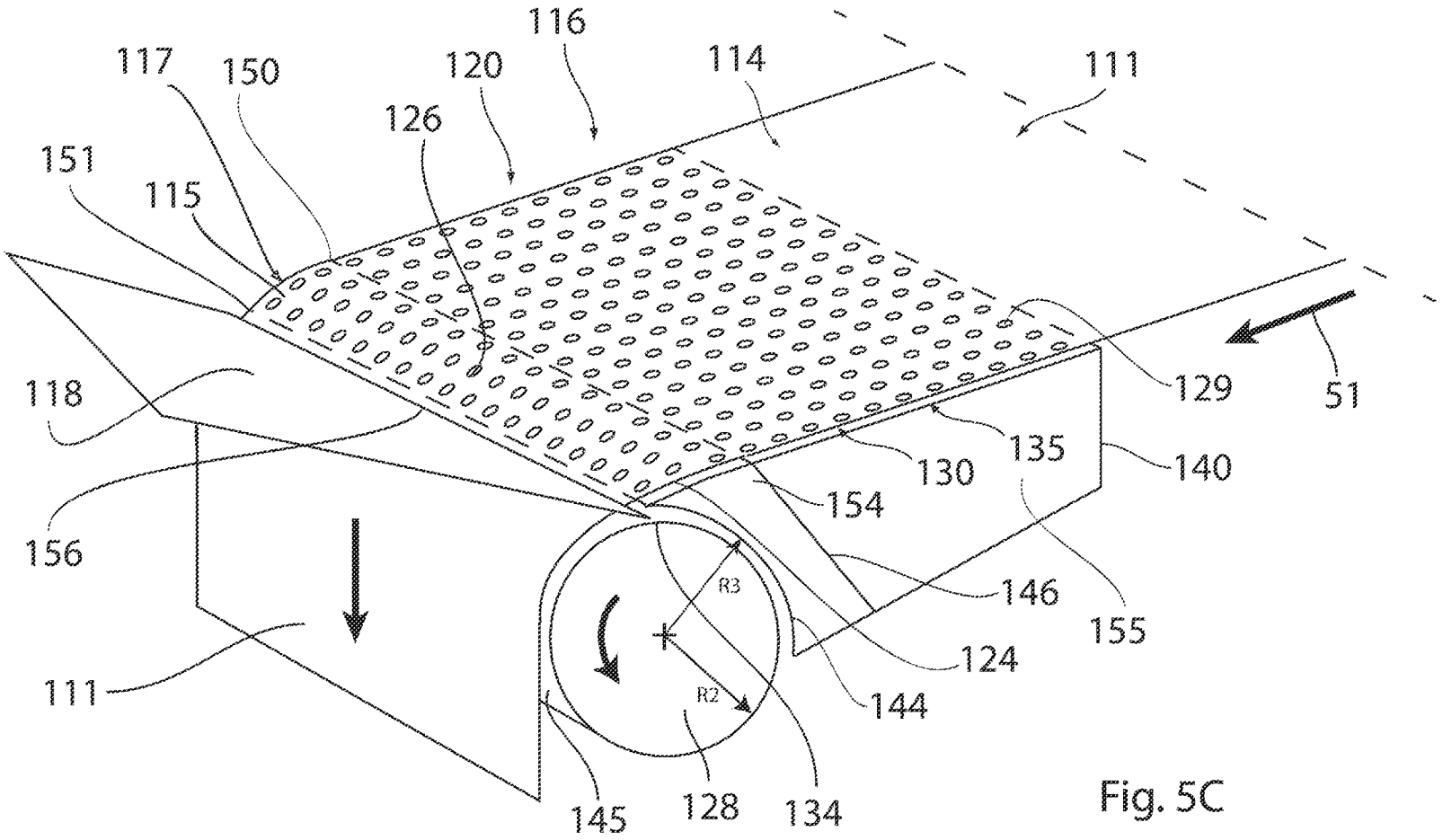
FIG. 5C shows an isometric view of a sheet separation system of the second embodiment.

Turning to FIGS. 5A, 5B and 5C, a roller 128 adjoins the overpressure curved sliding surface at the downstream end thereof and guides the metal transport belt downstream from the overpressure curved sliding surface. The metal transport belt is guided along its curved section 115 by the upstream curved sliding section 130, the overpressure curved sliding section 124 and the roller together. A radius (r1) of the curve is equal to a radius (r2) of the roller. In FIG. 5B the upstream curved sliding surface 130 and the overpressure curved sliding surface 124 extends over an angle of curvature of about 30 degrees.

The roller guides the metal transport belt over an angle of at most 60 degrees to a total angle of about 90 degrees. The overpressure curved sliding surface is located at least partially vertically above the roller. The overpressure curved sliding surface 124 is located vertically above a highest point 134 of the roller.

The overpressure curved sliding surface 124 extends to a region 132 downstream of the highest point 134 of the roller. The overpressure curved sliding surface 124 is located downstream of a vertical plane 136 extending through an upstream point 138 on the roller.

The stationary sliding surface 120 is defined by a body 140 having a curved upper side 142 which defines the overpressure curved sliding surface and the upstream curved sliding surface 130. The body 140 has an underside 144 which is also curved and has a same curvature radius r3 as the roller. The curved underside 144 is positioned in close proximity with the roller.

The stationary sliding surface 120 alone or together with the roller 128 guides the metal transport belt over a curvature of at least 90 degrees.

Turning in particular to FIG. 5C, the blow holes 126 are shown. The blow holes are located underneath the metal transport belt 111 and for this reason the blow holes 126 are shown in dashed lines. The overpressure zone 117 is defined by the area where the blow holes are located. The overpressure zone has an upstream end 150 and a downstream end 152 which are both indicated by dashed lines.

The upstream curved sliding surface 130 is shown with its suction holes 129. The body 140 further defines the upstream straight sliding surface 135. Here, further suction holes 129 are present, and a number are shown in FIG. 5C.

The body 140 which defines the stationary sliding surface 120 comprises a partition wall 146 which divides the interior volume in an overpressure chamber 154 and an underpressure chamber 155. The over pressure chamber is connected to a source of pressurized air and the underpressure chamber is connected to a suction device.

The sheet separation guide 118 has an upstream edge 156 which directly adjoins the overpressure zone.

In operation, sheets are transported by the endless metal transport belt 111 in a transport direction 51. The metal transport belt comprises multiple holes through which an underpressure is applied on the sheets. As a result of the underpressure the sheets remain attached to the metal transport belt. The metal transport belt comprises a straight section 114 and a curved section 115. The curved section is located downstream from the straight section. In the curved section, the metal transport belt curves and changes direction.

When the sheets reach the curved section a local overpressure is applied on the front end of the sheets through the blow holes 28 in the curve and through the through holes in the metal transport belt. A front end 125 of the sheet is separated from the metal transport belt as a result of the local overpressure.

Subsequently, the she is guided away from the metal transport belt by the separation guide which directly adjoins the overpressure zone.

The skilled person will understand that the printing system may be an inkjet printer, but other types of printing systems are conceivable.

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting, but rather, to provide an understandable description of the invention.

The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language, not excluding other elements or steps). Any reference signs in the claims should not be construed as limiting the scope of the claims or the invention.

The mere fact that certain measures are recited in mutually different dependent claims does not indicate that a combination of these measures cannot be used to advantage.

The invention claimed is:

1. A printing system comprising:

an endless metal transport belt for transporting sheets in a transport direction, wherein the metal transport belt comprises multiple through-holes through which an underpressure or overpressure may be applied on the sheets, and wherein the metal transport belt comprises a straight section and a curved section downstream from the straight section where the metal transport belt curves and changes direction;

a sheet separation system for separating the sheets from the metal transport belt, comprising a stationary sliding surface over which the metal transport belt is slideable, the stationary sliding surface comprising a number of blow holes defining an overpressure zone formed in a curved part of the stationary sliding surface, the overpressure zone having an upstream end and a downstream end which are determined by the location of the blow holes, the number of blow holes being connected to a source of pressurized air and configured to apply a local overpressure in the overpressure zone through the metal transport belt onto the underside of the sheets to separate a front end of the sheets from the metal transport belt; and a sheet separation guide which guides the separated sheets away from the metal transport belt, wherein the sheet separation guide is positioned at the curved section, downstream of the stationary sliding surface, and directly adjoining the overpressure zone at the downstream end thereof.

2. The printing system according to claim 1, wherein the blow holes in the overpressure in the curved part of the stationary sliding surface are located in a region where the metal transport belt has an inclination angle to the horizontal of between 15 and 50 degrees.

3. The printing system according to claim 1, further comprising an upstream curved sliding surface which is located directly upstream from the overpressure zone, and wherein the upstream curved sliding surface comprises holes which are connected to a suction device for applying underpressure on the sheets directly upstream of the overpressure zone.

4. The printing system according to claim 1, wherein the stationary sliding surface comprises a downstream curved sliding surface which is located downstream from the overpressure zone, wherein the downstream curved sliding surface guides the metal transport belt further along the curved section, and wherein the downstream curved sliding surface is in particular free of blow holes.

5. The printing system according to claim 1, wherein the stationary sliding surface is defined by three distinct parts:

an upstream curved sliding surface defining an underpressure zone, an overpressure curved sliding surface formed by the curved part which forms the overpressure zone, which overpressure curved sliding surface defines the overpressure zone, and a downstream curved sliding surface which is positioned downstream from the sheet separation guide.

6. The printing system according to claim 1, wherein the curved part of the stationary sliding surface guides the metal transport belt along the entire curved section over an angle of at least 90 degrees.

7. The printing system according to claim 1, wherein there is no roller at the curved section of the metal transport belt.

8. The printing system according to claim 1, wherein a roller adjoins the overpressure zone in the curved part of the stationary sliding surface at the downstream end thereof and guides the metal transport belt downstream from the overpressure zone in the curved part of the stationary sliding surface, and wherein the transport belt is guided by the curve and the roller together.

9. The printing system according to claim 8, wherein the stationary sliding surface is defined by a body having an underside which is curved and has a same curvature radius as a radius of the roller, and wherein the curved underside is positioned in close proximity with the outer surface of the roller.

10. The printing system according to claim 8, wherein the roller guides the metal transport belt over an angle of at least 70 degrees to 90 degrees.

11. The printing system according to claim 8, wherein the curved part which forms the overpressure zone is located at least partially vertically above the roller.

12. The printing system according to claim 8, wherein the curved part which forms the overpressure zone extends to a region downstream of the highest point of the roller.

13. The printing system according to claim 1, wherein the stationary sliding surface by itself guides the metal transport belt over a curvature of at least 90 degrees.

14. The printing system according to claim 1, wherein the printing system is an inkjet printing system.

15. A method of separating sheets from an endless metal transport belt in a printing system, the method comprising the steps of:

providing a printing system comprising:

an endless metal transport belt for transporting sheets in a transport direction, wherein the metal transport belt comprises multiple through holes through which an underpressure or overpressure may be applied on the sheets, and wherein the metal transport belt comprises a straight section and a curved section downstream from the straight section where the metal transport belt curves and changes direction;

a sheet separation system for separating the sheets from the metal transport belt, wherein the sheets are separated from the metal transport belt by applying a local overpressure on an underside of the sheets in an overpressure zone; and a sheet separation guide which guides the separated sheets away from the metal transport belt, wherein the sheet separation guide is positioned at the curved section, wherein the sheet separation system comprises a stationary sliding surface positioned under the metal transport belt and upstream of the sheet separation guide, wherein the metal transport belt slides over the stationary sliding surface, and wherein the stationary sliding surface comprises a number of blow holes which define the overpressure zone, the blow holes being connected to a source of pressurized air, wherein the blow holes are configured to apply a local overpressure in the overpressure zone through the metal transport belt onto the underside of the sheets to separate a front end of the sheets from the metal transport belt, and wherein the overpressure zone is formed in a curved part of the stationary sliding surface, wherein the overpressure zone has an upstream end and a downstream end which are determined by the location of the blow holes, and wherein the sheet separation guide directly adjoins the overpressure zone at the downstream end thereof, transporting a sheet with the endless metal transport belt toward and along the curved section, wherein the metal transport belt is guided along at least a part of the curved section by the curved part which forms the overpressure zone of the stationary sliding surface, and wherein a local overpressure is applied through the blow holes, thereby separating a front end of the sheet from the metal transport belt; and guiding the sheet away from the metal transport belt by the sheet separation guide which directly adjoins the overpressure zone at the downstream end thereof.

16. The printing system according to claim 8, wherein the curved part which forms the overpressure zone is located vertically above a highest point of the roller.

17. The printing system according to claim 8, wherein the curved part which forms the overpressure zone is located downstream of a vertical plane extending through an upstream point on the roller.

18. The printing system according to claim 8, wherein the stationary sliding surface together with the roller guides the metal transport belt over a curvature of at least 90 degrees.

19. A printing system comprising:

an endless metal transport belt for transporting sheets in a transport direction, wherein the metal transport belt comprises multiple through-holes through which an underpressure or overpressure may be applied on the sheets, and wherein the metal transport belt comprises a straight section and a curved section downstream from the straight section where the metal transport belt curves and changes direction;

a sheet separation system for separating the sheets from the metal transport belt, comprising a stationary sliding surface over which the metal transport belt is slideable, the stationary sliding surface comprising a number of blow holes defining an overpressure zone formed in a curved part of the stationary sliding surface, the overpressure zone having an upstream end and a downstream end which are determined by the location of the blow holes, the number of blow holes being connected to a source of pressurized air and configured to apply a local overpressure in the overpressure zone through the metal transport belt onto the underside of the sheets to separate a front end of the sheets from the metal transport belt; and a sheet separation guide which guides the separated sheets away from the metal transport belt, wherein the sheet separation guide is positioned at the curved part of the stationary sliding surface, downstream of the stationary sliding surface, and adjoining the overpressure zone at the downstream end thereof.

20. The printing system according to claim 19, wherein an upstream edge of the sheet separation guide is positioned over an outer surface of the metal transport belt and directly adjoins the downstream end of the overpressure zone, and the sheet separation guide projects from the overpressure zone in a direction upward above a level of the downstream end of the overpressure zone.

* * * * *